US009330836B2

(12) United States Patent
Vendik et al.

(10) Patent No.: US 9,330,836 B2
(45) Date of Patent: May 3, 2016

(54) SELF-RESONANT APPARATUS FOR WIRELESS POWER TRANSMISSION SYSTEM

(71) Applicant: SAMSUNG ELECTRONICS CO., LTD., Suwon-si (KR)

(72) Inventors: Orest Genrihovich Vendik, St. Petersburg (RU); Dmitry Victorovich Kholodnyak, St.Petersburg (RU); Dmitry Sergeevich Kozlov, St.Petersburg (RU); Evgenia Yurevna Zameshaeva, St.Petersburg (RU); Irina Borisovna Vendik, St. Petersburg (RU); Keum Su Song, Seoul (KR); Mikhail Nikolaevich Makurin, Arkhangelsk (RU); Pavel Anatolevich Turalchuk, Vsevolozhsk (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 593 days.

(21) Appl. No.: 13/738,058

(22) Filed: Jan. 10, 2013

(65) Prior Publication Data

US 2013/0207479 A1 Aug. 15, 2013

(30) Foreign Application Priority Data

Jan. 10, 2012 (RU) ..... 2012100031
Jan. 10, 2013 (KR) ..... 10-2013-0002903

(51) Int. Cl.

| | |
|---|---|
| ***H01F 27/42*** | (2006.01) |
| ***H01F 38/14*** | (2006.01) |
| ***H01F 27/00*** | (2006.01) |
| *H01F 17/00* | (2006.01) |

(52) U.S. Cl.

CPC ..... *H01F 38/14* (2013.01); *H01F 27/006* (2013.01); *H01F 2017/0026* (2013.01)

(58) Field of Classification Search

CPC ..... H02J 5/005; H02J 17/00; H02J 7/025; H02J 3/01; H04B 5/0037; B60L 11/1829

See application file for complete search history.

(56) References Cited

U.S. PATENT DOCUMENTS

| | | | | |
|---|---|---|---|---|
| 3,733,608 | A * | 5/1973 | McGhay et al. | 370/339 |
| 4,874,916 | A * | 10/1989 | Burke | 219/671 |
| 5,661,369 | A * | 8/1997 | Sanderson | 315/105 |
| 2005/0270091 | A1 * | 12/2005 | Kozyrev et al. | 330/4.5 |
| 2008/0164960 | A1 * | 7/2008 | Schnell et al. | 333/219.2 |
| 2011/0317275 | A1 * | 12/2011 | Smith et al. | 359/652 |

* cited by examiner

*Primary Examiner* — Jared Fureman
*Assistant Examiner* — Rafael Pacheco
(74) *Attorney, Agent, or Firm* — NSIP Law

(57) ABSTRACT

Provided is a self-resonant apparatus in relation to electric and radio technologies, and more particularly, to a wireless power transmission system, the self-resonant apparatus including ring resonators. Here, the ring resonators may be represented by a combination having metamaterial features, the combination may include split-ring resonators (SRRs) connected in parallel to capacitors, a front surface and a rear surface of each of the SRRs may be connected to be twisted in an alternating pattern, and each SRR may be executed as a metal strip mounted on a dielectric layer and connected to a neighboring SRR by a series capacitor.

19 Claims, 11 Drawing Sheets

SELF-RESONANT APPARATUS FOR WIRELESS POWER TRANSMISSION SYSTEM

BACKGROUND

1. Field

The following description relates to electric and radio technologies, and more particularly, to a wireless power transmission system.

2. Description of Related Art

A number of solutions in the field of power transmission via radio waves have been suggested, the basic ideas of which were first suggested by Nikola Tesla.

A device known as a "rectenna" may be used for transmitting wireless energy. The rectenna refers to a rectifying antenna used for performing a direct conversion of microwave energy into direct current (DC) electricity. In general, different types of antennas may be used for receiving radio frequency (RF) signals.

Wireless power transmission systems may operate in a gigahertz (GHz) frequency range. One drawback of such wireless power transmission systems is that certain frequency ranges can cause health problems for humans.

SUMMARY

In one general aspect, there is provided a self-resonant apparatus for a wireless power transmission system, the self-resonant apparatus including ring resonators, wherein the ring resonators may be represented by a combination having metamaterial features, the combination may include split-ring resonators (SRRs) connected in parallel to capacitors, a front surface and a rear surface of each of the SRRs may be connected to be twisted in an alternating pattern, and each SRR may be executed as a metal strip mounted on a dielectric layer and connected to a neighboring SRR by a series capacitor.

The SRRs may revolve, and an angle of the revolving may be determined for a series surface-mounted capacitor to have an optimal amount of space for mounting.

The SRRs may be provided in a round or polygonal shape.

A thickness of the dielectric layer may be in a range of 50 micrometers (μm) to 1500 μm.

A dielectric permittivity of the dielectric layer may correspond to a value in a range of 2 $\in_r$ to 20 $\in_r$.

At least two SRRs may be provided.

An operational frequency band of the SRRs may be in a range of 1 megahertz (MHz) to 100 MHz.

The SRRs connected in parallel to the capacitors may be manufactured by low temperature co-fired ceramics technology or printed circuit board technology.

Each of the SRRs connected in parallel to the capacitors may include an equivalent circuit including a parallel resonant LC circuit and a series capacitor.

The parallel resonant LC circuit may include an inductive element and a capacitive element, and may be connected in series to an active reactance.

The combination may be represented by an equivalent circuit including a plurality of cells, each cell may include a parallel resonant circuit formed by an SRR and a capacitor being connected in parallel, and the plurality of cells may be connected in series via the series capacitor.

A combination of the parallel resonant circuit and the series capacitor may be followed by revealing two resonant responses of typical impedance with respect to a metamaterial.

A Q-factor of the combination may correspond to a value in a range of 100 to 200.

The self-resonant apparatus may further include a magnetic rode along an axis of the SRRs.

The magnetic rode may include ferrite.

The capacitors may be embedded in an internal portion of the dielectric layer having a high dielectric permittivity.

Other features and aspects will be apparent from the following detailed description, the drawings, and the claims.

Figure 1:
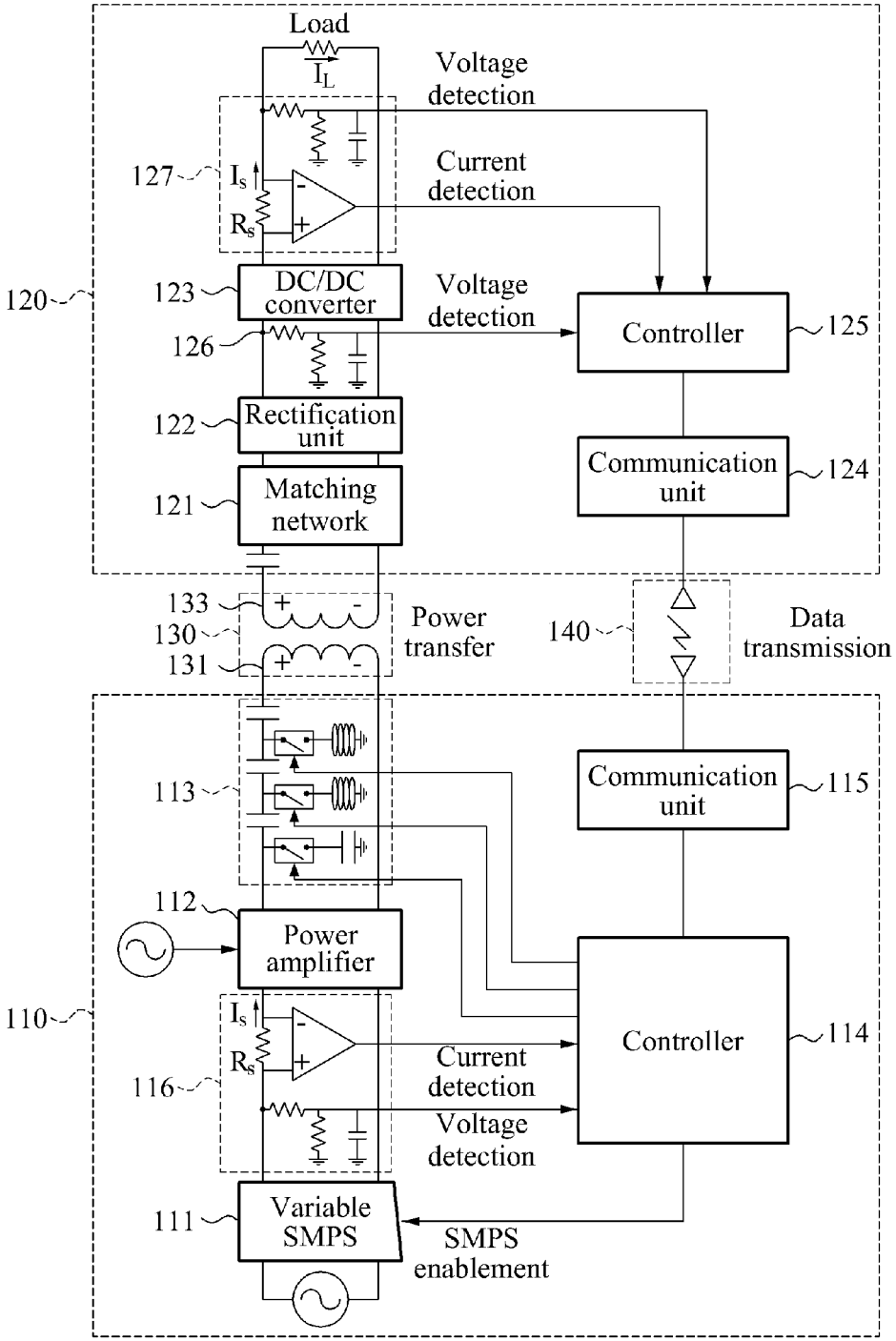
FIG. 1 is a diagram illustrating an example of a wireless power transmission system.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, description of well-known functions and constructions may be omitted for increased clarity and conciseness.

FIG. 1 illustrates an example of a wireless power transmission system.

Referring to FIG. 1, the wireless transmission system includes a source 110 and a target 120. The source 110 may be a device that supplies wireless power, and may include electronic devices enabling power supply, for example, a pad, a terminal, a television (TV), and the like. The target 120 may be a device that receives wireless power, and may include electronic devices that receive power, for example, a terminal, a TV, a washing machine, a radio, an electric light, and the like.

The source 110 includes a variable switching mode power supply (SMPS) 111, a power amplifier 112, a matching network 113, a controller 114, a communication unit 115, and a power detector 116.

The variable SMPS 111 may generate direct current (DC) voltage by switching alternating current (AC) voltage, for example, in a band of tens of hertz (Hz), which is output from a power supply. The variable SMPS 111 may output DC voltage of a predetermined level, or may adjust an output level of DC voltage based on the control of the controller 114.

The power detector 116 may detect output current and output voltage of the variable SMPS 111, and may transfer, to the controller 114, information about the detected current and the detected voltage. Additionally, the power detector 116 may detect input current and input voltage of the power amplifier 112.

The power amplifier 112 may generate power by converting DC voltage of a predetermined level to AC voltage, using a switching pulse signal, for example, in a band of a few megahertz (MHz) to tens of MHz. Accordingly, the power amplifier 112 may convert DC voltage supplied to the power amplifier 112 to AC voltage, using a reference resonant frequency $F_{Ref}$, and may generate communication power used for communication, or charging power used for charging. The communication power and the charging power may be used in a plurality of target devices.

The communication power may refer to low power of 0.1 milliwatt (mW) to 1 mW. The charging power may refer to high power of 1 mW to 200 W that is consumed by a device load of a target device. In various examples described herein, the term "charging" may refer to supplying power to a unit or element that is configured to receive power. Additionally, the term "charging" may refer to supplying power to a unit or element that is configured to consume power. The unit or element may include, for example, batteries, displays, sound output circuits, main processors, and various sensors.

Also, the term "reference resonant frequency" may refer to a resonant frequency that is used by the source 110. Additionally, the term "tracking frequency" may refer to a resonant frequency that is adjusted by a preset scheme.

The controller 114 may detect a wave of the communication power or the charging power that is reflected, and may detect mismatching that may occur between a target resonator 133 and a source resonator 131 based on the detected reflected wave. To detect the mismatching, for example, the controller 114 may detect an envelope of the reflected wave, a power amount of the reflected wave, and the like.

The matching network 113 may compensate for impedance mismatching between the source resonator 131 and the target resonator 133 to be optimal matching, under the control of the controller 114. The matching network 113 may be connected through a switch, based on a combination of a capacitor and an inductor, under the control of the controller 114.

The controller 114 may compute a voltage standing wave ratio (VSWR), based on a voltage level of the reflected wave, and based on a level of an output voltage of the source resonator 131 or the power amplifier 112. For example, when the VSWR is greater than a predetermined value, the controller 114 may determine that mismatching is detected.

In this example, the controller 114 may compute a power transmission efficiency for each of N tracking frequencies, may determine a tracking frequency $F_{Best}$ that has the best power transmission efficiency among the N tracking frequencies, and may adjust the reference resonant frequency $F_{Ref}$ to the tracking frequency $F_{Best}$. In various examples, the N tracking frequencies may be set in advance.

The controller 114 may adjust a frequency of a switching pulse signal. Under the control of the controller 114, the frequency of the switching pulse signal may be determined. For example, by controlling the power amplifier 112, the controller 114 may generate a modulation signal to be transmitted to the target 120. In other words, the communication unit 115 may transmit a variety of data 140 to the target 120 using in-band communication. The controller 114 may detect a reflected wave, and may demodulate a signal received from the target 120 through an envelope of the detected reflected wave.

The controller 114 may generate a modulation signal for in-band communication, using various ways. For example, the controller 114 may generate the modulation signal by turning on or off a switching pulse signal, by performing delta-sigma modulation, and the like. Additionally, the controller 114 may generate a pulse-width modulation (PWM) signal with a predetermined envelope.

The communication unit 115 may perform out-band communication through a communication channel. The communication unit 115 may include a communication module, such as one configured to process ZIGBEE®, BLUETOOTH®, and the like. The communication unit 115 may transmit the data 140 to the target 120 through the out-band communication.

The source resonator 131 may transfer electromagnetic energy 130 to the target resonator 133. For example, the source resonator 131 may transfer the communication power or charging power to the target 120, using magnetic coupling with the target resonator 133.

As illustrated in FIG. 1, the target 120 includes a matching network 121, a rectification unit 122, a DC/DC converter 123, a communication unit 124, a controller 125, and a power detector 127.

The target resonator 133 may receive the electromagnetic energy 130 from the source resonator 131. For example, the target resonator 133 may receive the communication power or charging power from the source 110 through magnetic coupling with the source resonator 131. Additionally, the target resonator 133 may receive the data 140 from the source 110 using the in-band communication.

The matching network 121 may match an input impedance viewed from the source 110 to an output impedance viewed from a load. The matching network 121 may include a combination of a capacitor and an inductor.

The rectification unit 122 may generate DC voltage by rectifying AC voltage. The AC voltage may be received from the target resonator 133.

The DC/DC converter 123 may adjust a level of the DC voltage that is output from the rectification unit 122, based on a capacity required by the load. As an example, the DC/DC converter 123 may adjust the level of the DC voltage output from the rectification unit 122 from 3 volts (V) to 10 V.

The power detector 127 may detect voltage of an input terminal 126 of the DC/DC converter 123, and current and voltage of an output terminal of the DC/DC converter 123. The detected voltage of the input terminal 126 may be used to compute a transmission efficiency of power received from the source 110. Additionally, the detected current and the detected voltage of the output terminal may be used by the controller 125 to compute an amount of power transferred to the load. The controller 114 of the source 110 may determine an amount of power that needs to be transmitted by the source 110, based on power required by the load and power transferred to the load.

When power of the output terminal computed using the communication unit 124 is transferred to the source 110, the source 110 may compute an amount of power that needs to be transmitted.

The communication unit 124 may perform in-band communication to transmit or receive data using a resonant frequency. During the in-band communication, the controller 125 may demodulate a received signal by detecting a signal between the target resonator 133 and the rectification unit 122, or detecting an output signal of the rectification unit 122. In other words, the controller 125 may demodulate a message received using the in-band communication. Additionally, the controller 125 may adjust an impedance of the target resonator 133 using the matching network 121, to modulate a signal to be transmitted to the source 110. For example, the controller 125 may increase the impedance of the target resonator 133, so that a reflected wave may be detected from the controller 114 of the source 110. Depending on whether the reflected wave is detected, the controller 114 may detect a binary number, for example "0" or "1."

The communication unit 124 may transmit a response message to the communication unit 115 of the source 110. For example, the response message may include a "type of a corresponding target," "information about a manufacturer of a corresponding target," "a model name of a corresponding target," a "battery type of a corresponding target," a "scheme of charging a corresponding target," an "impedance value of a load of a corresponding target," "information on characteristics of a target resonator of a corresponding target," "information on a frequency band used by a corresponding target," an "amount of a power consumed by a corresponding target," an "identifier (ID) of a corresponding target," "information on version or standard of a corresponding target," and the like.

The communication unit 124 may perform out-band communication using a communication channel. For example, the communication unit 124 may include a communication module, such as one configured to process ZIGBEE®, BLUETOOTH®, and the like. The communication unit 124 may transmit or receive the data 140 to or from the source 110 using the out-band communication.

The communication unit 124 may receive a wake-up request message from the source 110, and the power detector 127 may detect an amount of power received by the target resonator 133. The communication unit 124 may transmit, to the source 110, information about the detected amount of the power. Information on the detected amount may include, for example, an input voltage value and an input current value of the rectification unit 122, an output voltage value and an output current value of the rectification unit 122, an output voltage value and an output current value of the DC/DC converter 123, and the like.

Referring to FIG. 1, the controller 114 may set a resonance bandwidth of the source resonator 131. Based on the set resonance bandwidth of the source resonator 131, a Q-factor (Qs) of the source resonator 131 may be determined.

The controller 125 may set a resonance bandwidth of the target resonator 133. Based on the set resonance bandwidth of the target resonator 133, a Q-factor of the target resonator 133 may be determined. In this example, the resonance bandwidth of the source resonator 131 may be wider or narrower than the resonance bandwidth of the target resonator 133.

Via a communication, the source 110 and the target 120 may share information regarding each of the resonance bandwidths of the source resonator 131 and the target resonator 133. When a power higher than a reference value is requested from the target 120, for example, the Q-factor (Qs) of the source resonator 131 may be set to a value greater than 100. When a power lower than the reference value is requested from the target 120, for example, the Q-factor (Qs) of the source resonator 131 may be set to a value less than 100.

In a resonance-based wireless power transmission, a resonance bandwidth may be an important factor. When Qt indicates a Q-factor based on a change in a distance between the source resonator 131 and the target resonator 133, a change in resonance impedance, impedance-mismatching, a reflected signal, and the like, Qt may be in inverse proportion to a resonance bandwidth, as given in Equation 1.

$$\frac{\Delta f}{f_0} = \frac{1}{Qt} = \Gamma_{S,D} + \frac{1}{BW_S} + \frac{1}{BW_D} \quad \text{[Equation 1]}$$

In Equation 1, $f_0$ denotes a center frequency, $\Delta f$ denotes a bandwidth, $\Gamma_{S,D}$ denotes a reflection loss between resonators, $BW_S$ denotes a resonance bandwidth of the source resonator 131, and $BW_D$ denotes a resonance bandwidth of the target resonator 133.

In a wireless power transmission, an efficiency U of the wireless power transmission may be given by Equation 2.

$$U = \frac{\kappa}{\sqrt{\Gamma_S \Gamma_D}} = \frac{\omega_0 M}{\sqrt{R_S R_D}} = \frac{\sqrt{Q_S Q_D}}{Q_\kappa} \quad \text{[Equation 2]}$$

In Equation 2, $\kappa$ denotes a coupling coefficient regarding energy coupling between the source resonator 131 and the target resonator 133, $\Gamma_S$ denotes a reflection coefficient of the source resonator 131, $\Gamma_D$ denotes a reflection coefficient of the target resonator 133, $\omega_0$ denotes a resonant frequency, M denotes a mutual inductance between the source resonator 131 and the target resonator 133, $R_S$ denotes an impedance of the source resonator 131, $R_D$ denotes an impedance of the target resonator 133, $Q_S$ denotes a Q-factor of the source resonator 131, $Q_D$ denotes a Q-factor of the target resonator 133, and $Q_\kappa$ denotes a Q-factor regarding energy coupling between the source resonator 131 and the target resonator 133.

Referring to Equation 2, the Q-factor may be highly associated with an efficiency of the wireless power transmission.

Accordingly, the Q-factor may be set to a great value in order to increase the efficiency of the wireless power transmission. In this example, when $Q_S$ and $Q_D$ are respectively set to a significantly great value, the efficiency of the wireless power transmission may be reduced based on a change in the coupling coefficient K regarding the energy coupling, a change in a distance between the source resonator 131 and the target resonator 133, a change in a resonance impedance, impedance mismatching, and the like.

When each of the resonance bandwidths of the source resonator 131 and the target resonator 133 is set to be too narrow in order to increase the efficiency of the wireless power transmission, the impedance mismatching and the like may easily occur due to insignificant external influences. In consideration of the impedance mismatching, Equation 1 may be expressed by Equation 3.

$$\frac{\Delta f}{f_0} = \frac{\sqrt{VSWR} - 1}{Qt\sqrt{VSWR}} \quad \text{[Equation 3]}$$

In FIG. 1, the source 110 may transmit a wake-up power wirelessly, to be used to wake up the target 120. The source 110 may broadcast a configuration signal to configure a wireless power transmission network. The source 110 may receive a search frame including a receiving sensitivity value of the configuration signal from the target 120. The source 110 may allow the target 120 to join the wireless power transmission network. Here, the source 110 may transmit an identifier to the target 120 to identify the target 120 in the wireless power transmission network. The source 110 may generate charging power through a power control, and transmit the charging power to the target wirelessly.

In addition, the target 120 may receive wake-up power from at least one of a plurality of source devices. The target 120 may activate a communication function using the wake-up power. The target 120 may receive a configuration signal to configure a wireless power transmission network of each of the plurality of source devices. As an example, the target 120 may select the source 110 based on a receiving sensitivity of the configuration signal, and receive power from the selected source 110 wirelessly.

Figure 2:
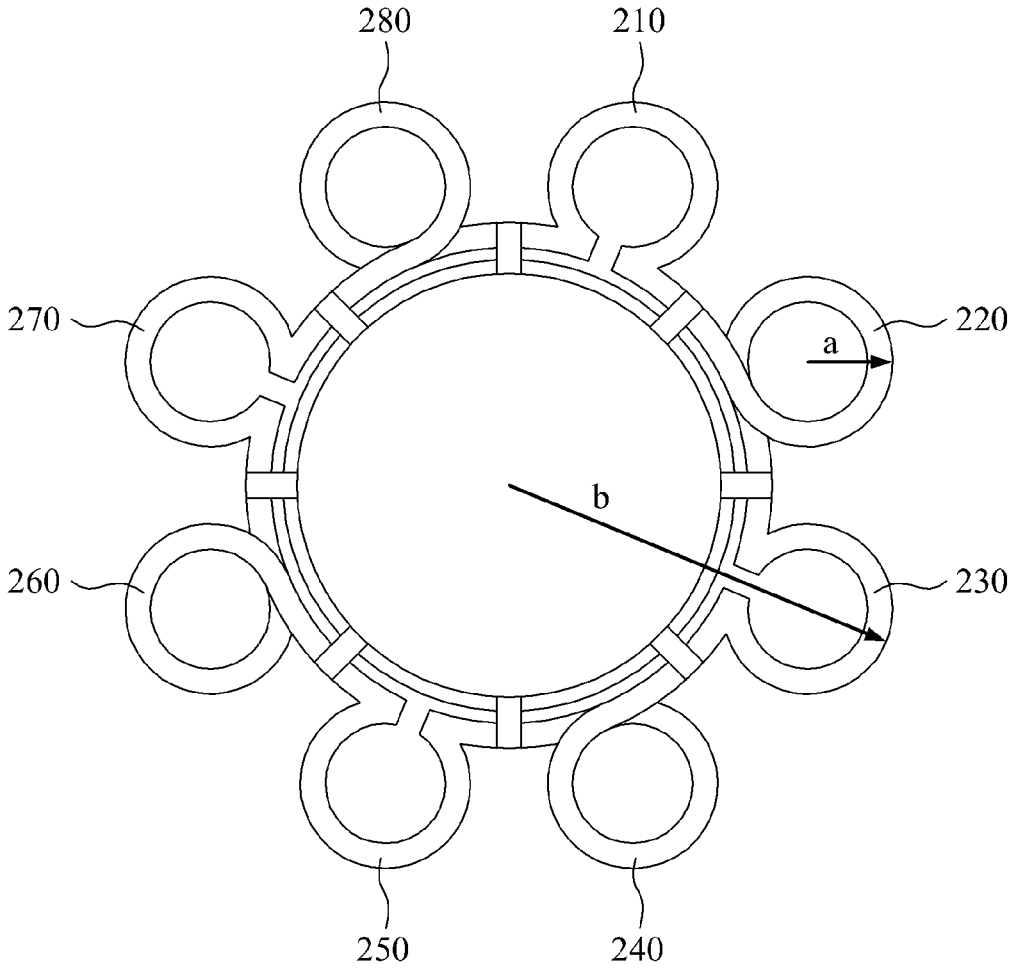
FIG. 2 is a diagram illustrating an example of a flat petal resonant structure including eight petals of a self-resonant apparatus for a wireless power transmission system.

FIG. 2 illustrates an example of a flat petal resonant structure including eight petals of a self-resonant apparatus for a wireless power transmission system.

Referring to FIG. 2, a metamaterial self-resonant structure of the self-resonant apparatus for the wireless power transmission system may be a multi-layer structure including a plurality of identical cells 210 through 280. The plurality of cells 210 through 280 may respectively include a split-ring resonator (SRR) and a parallel capacitor. Each of the plurality of cells 210 through 280 may be connected in series to a series capacitor. By way of example, all capacitors may be represented by surface-mounted elements.

The self-resonant structure may be designed as a combination of parallel resonant circuits and series capacitors. In FIG. 2, 'a' denotes a radius of each of the plurality of cells 210 through 280, and 'b' denotes a radius of the self-resonant apparatus for the wireless power transmission system.

Figure 3:
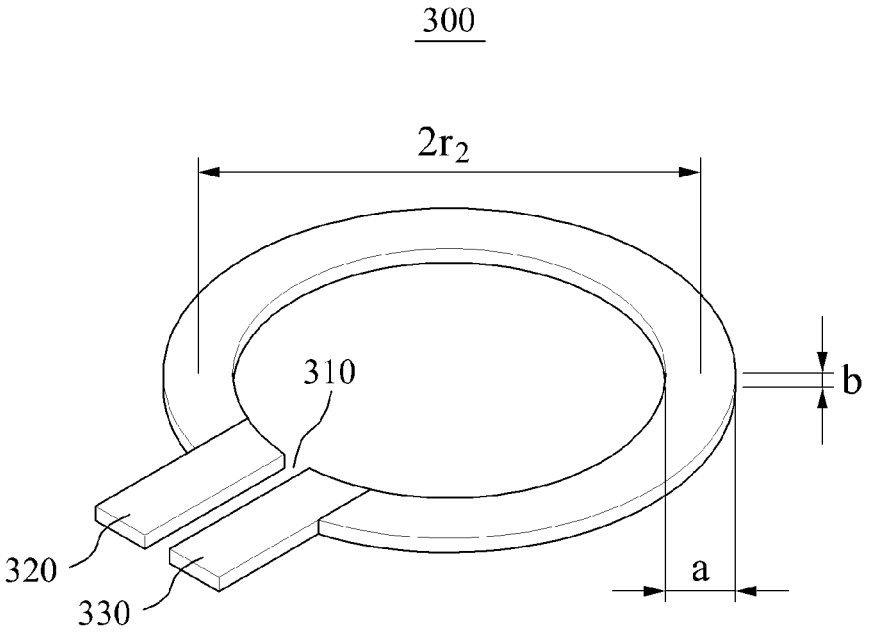
FIG. 3 is a diagram illustrating an example of a single split-ring resonator (SRR) of a self-resonant apparatus for a wireless power transmission system.

FIG. 3 illustrates an example of a structure of a single SRR 300 of a self-resonant apparatus for a wireless power transmission system.

Referring to FIG. 3, the SRR 300 may be in a shape of a ring including a gap 310. The SRR 300 may include thin metallic strips 320 and 330. For example, the metallic strips 320 and 330 may include copper. The metallic strips 320 and 330 may be disposed on a dielectric layer. A thickness 'b' of the metallic strip 320 or 330 may be less than a width 'a' of the metallic strip 320 or 330.

For example, in FIG. 3, $2r_2$ denotes a diameter of the SRR 300, 'a' denotes a width of the metallic strip 320 or 330, and 'b' denotes a thickness of the metallic strip 320 or 330. At an edge of the gap 310, the metallic strips 320 and 330 may be configured for oscillation. A thickness of the dielectric layer may be in a range of 10 micrometers (μm) to 1500 μm. A dielectric permittivity of the dielectric layer may correspond to a value in a range of $2 \in_r$ to $20 \in_r$.

The SRR 300 may have a form of a polygon having an arbitrary number of sides. The arbitrary number of sides may be determined based on technology for mounting a capacitor to be connected to the SRR 300.

Figure 4:
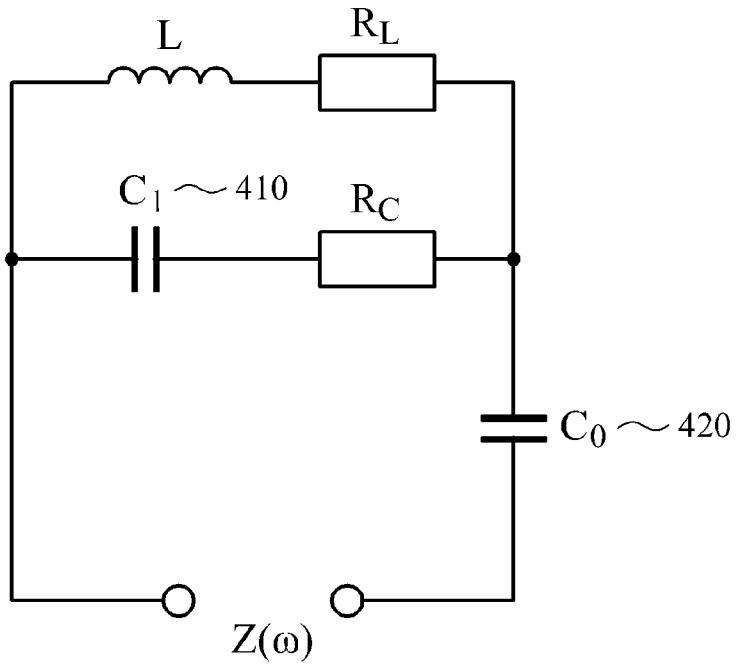
FIG. 4 is a diagram illustrating an example of an equivalent circuit of a single SRR including a series capacitor and a parallel capacitor in a self-resonant apparatus for a wireless power transmission system.

FIG. 4 illustrates an example of an equivalent circuit of a single SRR including a series capacitor and a parallel capacitor in a self-resonant apparatus for a wireless power transmission system.

Referring to FIG. 4, a self-resonant structure including a plurality of identical cells is represented by an equivalent circuit.

Each cell may be represented by a parallel LC circuit including a parallel capacitor $C_1$ 410 connected to an SRR. The plurality of identical cells may be connected in series by a series capacitor $C_0$ 420. The equivalent circuit of the self-resonant structure may be transformed to a series connection circuit of the plurality of identical cells being connected in series.

Figure 5:
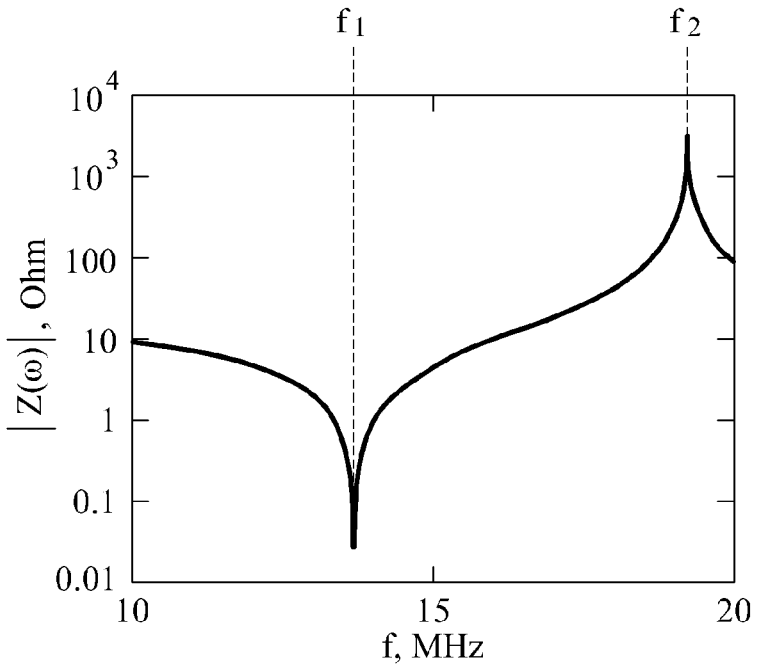
FIG. 5 is a graph illustrating an example of a frequency dependence of a magnitude of an input impedance of a resonant cell.

FIG. 5 is a graph that illustrates an example of a frequency dependence of a magnitude of an input impedance of a resonant cell.

Referring to FIG. 5, when the equivalent circuit of FIG. 4 is considered, the frequency dependence of the magnitude of the input impedance may exhibit two resonances. The two resonances are a series resonance, generally known as "resonance", at a frequency $f_1$, and a parallel resonance, generally known as "antiresonance", at a frequency $f_2$.

The resonant frequency $f_1$ may be a frequency corresponding to a minimum input impedance of the self-resonant apparatus, and the resonant frequency $f_2$ may be a frequency corresponding to a maximum input impedance. The resonance and the antiresonance in an oscillating system may be typical for a metamaterial resonant structure for providing a high quality factor of the system.

The resonant frequency may be determined by values of the capacitors $C_0$ 420 and $C_1$ 410, and by an impedance of the SRR calculated from the equivalent circuit of FIG. 4. A maximum efficiency of energy transmission may be provided when the self-resonant apparatus operates at the resonant frequency $f_1$.

Figure 6:
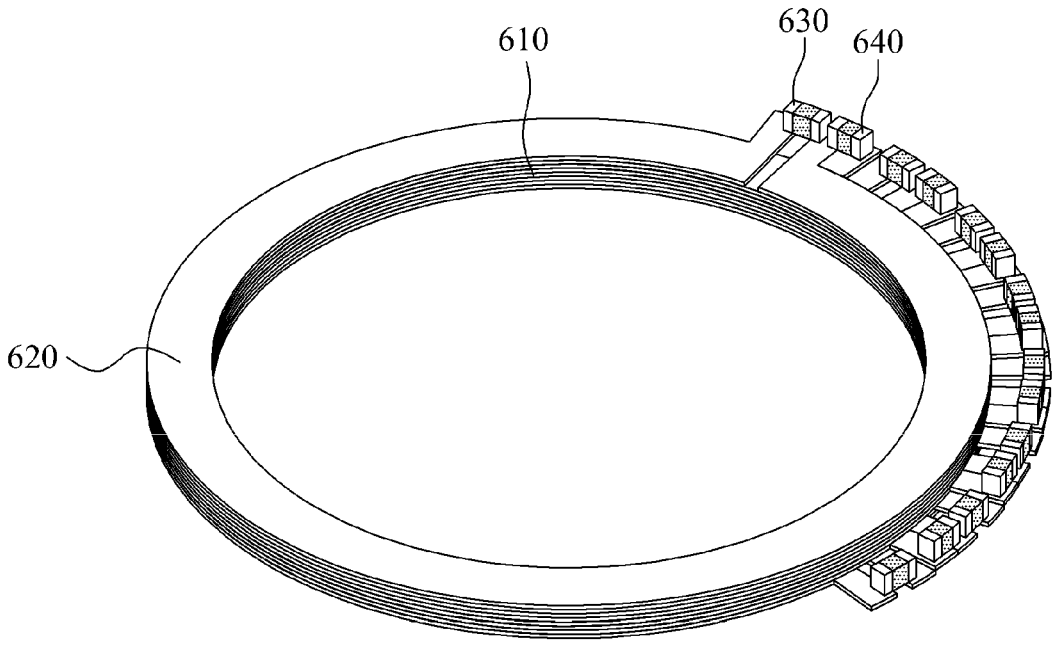
FIG. 6 is a diagram illustrating an example of a metamaterial resonant structure.

FIG. 6 illustrates an example of a metamaterial resonant structure.

Referring to FIG. 6, a metamaterial multi-layer self-resonant structure may include a plurality of layers. The self-resonant structure may include a dielectric layer 610, a first metallic layer 620 corresponding to an SRR, a parallel capacitor 630, and a series capacitor 640. The metallic layer 620 may be represented by an SRR topology along with the parallel capacitor 630 and the series capacitor 640. The first metallic layer 620 may be shunted by the parallel capacitor 630. Each SRR may be connected in series to adjacent SRRs by the series capacitor 640.

Components located on different layers may be connected by means of metalized openings, for example, holes, and transit connectors.

Dielectric layers 610 each covered with a pattern of an SRR may be disposed one over the other, and revolve. For example, the dielectric layers 610 may turn, with respect to one another at a predetermined angle, as shown in FIG. 6. As an example, a dielectric layer may revolve at the predetermined angle and be disposed on a lower dielectric layer.

An angle between two adjacent SRRs for example, neighboring SRRs, may be determined in a manner to provide a sufficient amount of space for placement of the series surface mounted capacitor 640. Each SRR of the parallel capacitor 630 and the series capacitor 640 may be described by an equivalent electrical circuit including a parallel LC circuit connected in series to the series capacitor 640. Each parallel circuit may include an inductance and a capacitor connected in series to an active resistance.

Figure 7:
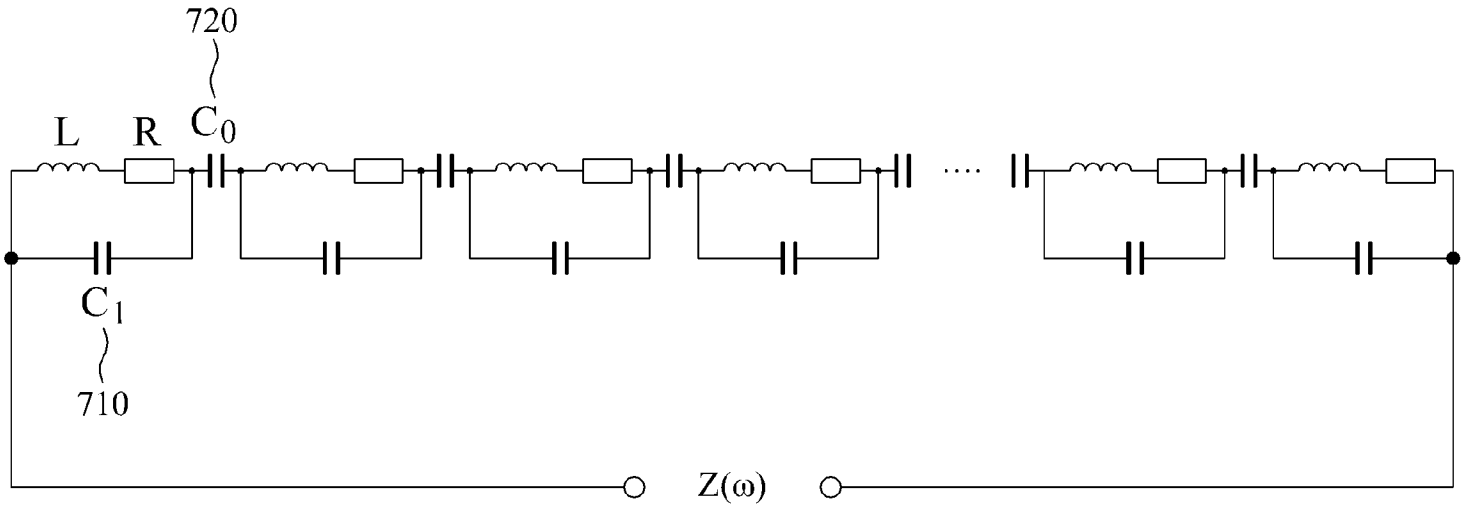
FIG. 7 is a diagram illustrating an example of an equivalent circuit of a self-resonant apparatus for a wireless power transmission system having a multi-layer resonant structure.

FIG. 7 illustrates an example of an equivalent circuit of a self-resonant apparatus for a wireless power transmission system having a multi-layer resonant structure.

Referring to FIG. 7, the equivalent circuit of the self-resonant structure may include a plurality of identical cells. Each cell may include a parallel LC circuit including an SRR and a parallel capacitor 710 connected to the SRR. Here, the SRR may be an equivalent of a single-turn inductor. The plurality of cells may be connected in series by a series capacitor 720. The equivalent circuit of such structure may be converted into a series connection circuit of a number of identical cells being connected in series.

A series connection between a plurality of SRRs may provide a higher inductance, and assume a higher value of load impedance. All inductors may be coupled by a mutual inductance which leads to an increase of a Q-factor of the self-resonant structure.

Figure 8:
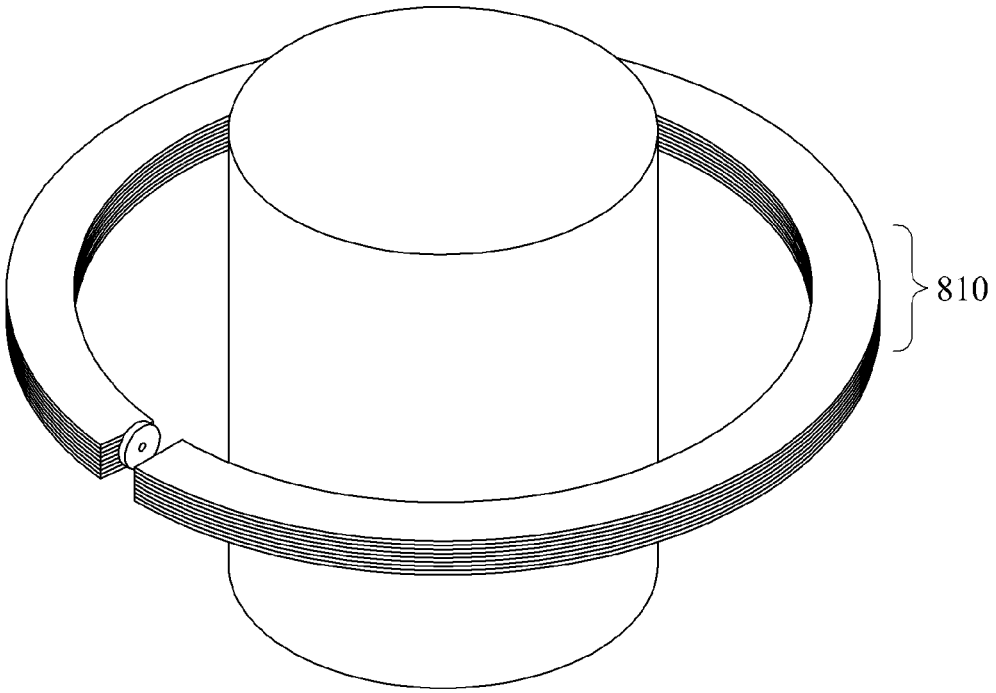
FIG. 8 is a diagram illustrating an example of a layer-by-layer design of a self-resonant apparatus for a wireless power transmission system having a multi-layer resonant structure.

FIG. 8 illustrates an example of a layer-by-layer design of a self-resonant apparatus for a wireless power transmission system having a multi-layer resonant structure.

With regard to FIG. 8, FIG. 6 may be referred to with respect to a configuration of a single layer SRR including layers 810 in a multi-layer resonant structure including 1, 2, . . . , an N number of layers.

Figure 9:
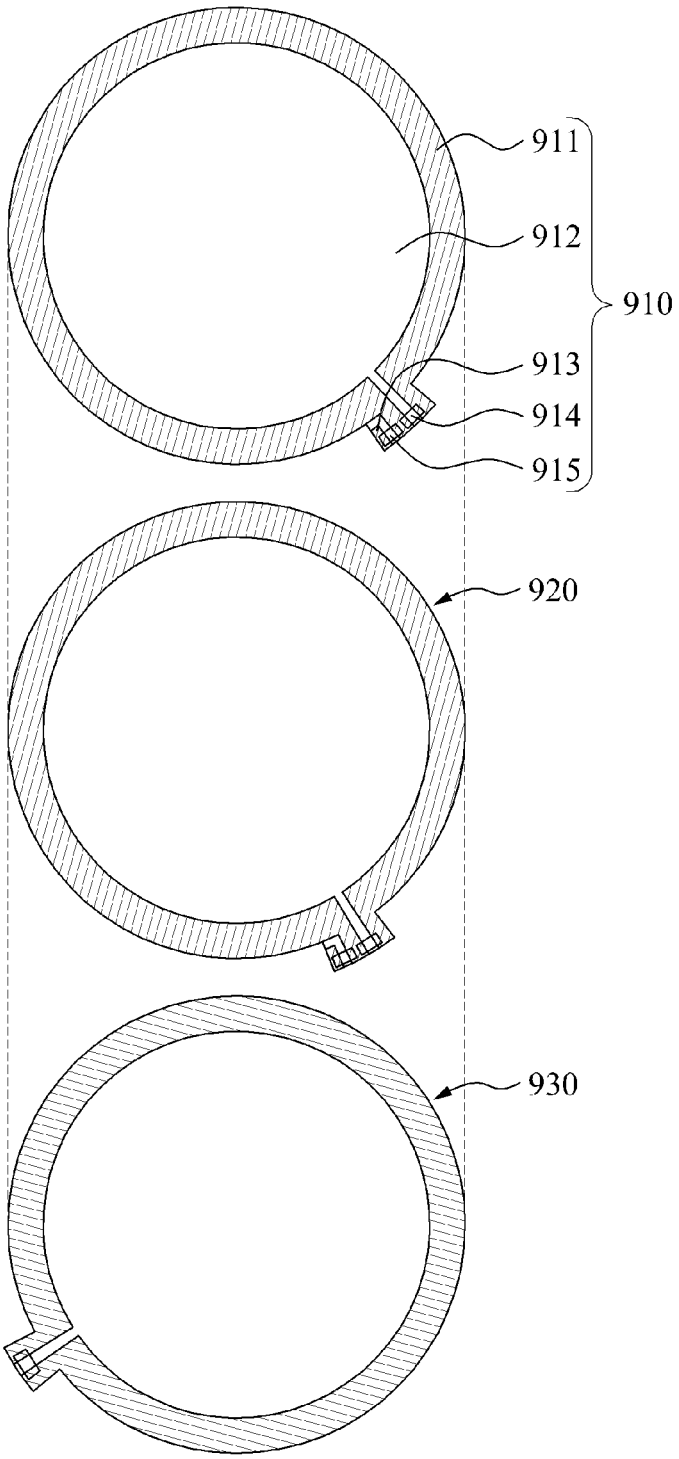
FIG. 9 is a diagram illustrating an example of a multi-layer self-resonant structure including coupling capacitors of a self-resonant apparatus for a wireless power transmission system.

FIG. 9 illustrates an example of a multi-layer self-resonant structure including coupling capacitors of a self-resonant apparatus for a wireless power transmission system.

Figure 10:
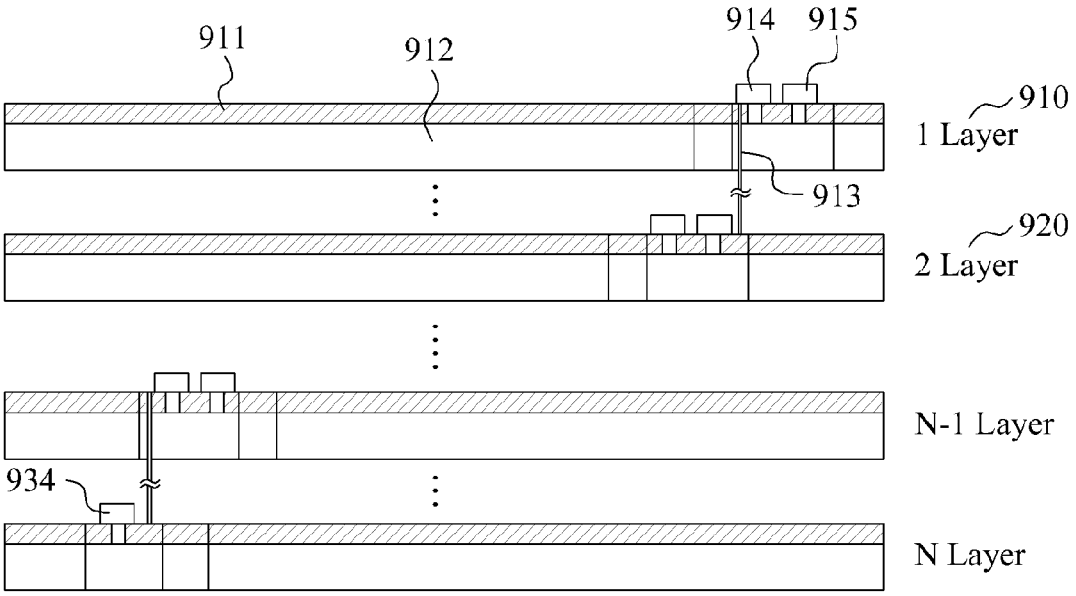
FIG. 10 is a cross-sectional view of an example of a multi-layer self-resonant structure including coupling capacitors.

FIG. 10 illustrates an example of a multi-layer self-resonant structure including coupling capacitors.

Referring to FIGS. 9 and 10, a circuit of a multi-layer self-resonant structure set may guarantee a small size ($<\lambda/100$, where $\lambda$—is the wave length), and a substantially higher quality factor ($Q \approx 150$ to 200).

The multi-layer self-resonant structure may operate at a frequency in a range of 1 MHz to 100 MHz. A large number of used layers may increase an input impedance of the multi-layer self-resonant structure which results in an increase of a load resistance value.

In order to obtain more uniform magnetic flux through an SRR 910, a magnetic rode, for example, a ferrite core, may be inserted along a common axis of the SRR 910. In the multi-layer self-resonant structure, the SRR 910 may include a metallic layer 911, a dielectric layer 912, a via interconnection 913, a series surface mounted capacitor $C_0$ 914, and a parallel surface mounted capacitor $C_1$ 915. Cells 910, 920, and 930 may be configured in an identical structure, and revolve at an accurate angle.

Figure 11:
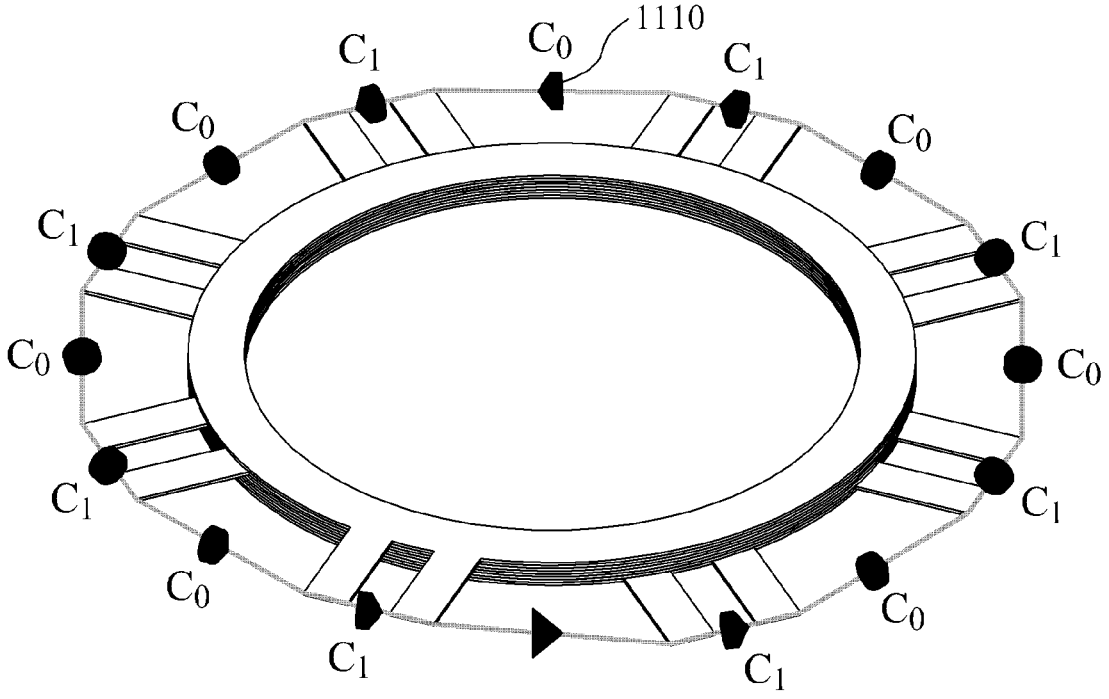
FIG. 11 is a diagram illustrating an example of a metamaterial resonant structure including a magnetic rode.

FIG. 11 illustrates an example of a metamaterial resonant structure including a magnetic rode.

Referring to FIG. 11, in a metamaterial self-resonant structure including the magnetic rode, a quality factor may increase when a current distribution in a conducting layer of an SRR is more uniform and a magnetic field inside the SRR is more uniform. The insertion of a magnetic rode 1110 into the SRR structure may entail an increase of an effective area of the SRR, and an enhancement of an effective coupling coefficient between transmitting and receiving coils of a power transmission system.

According to various examples, the resonant structure may be manufactured by low temperature co-fired ceramics technology or printed circuit board technology. Both technologies may allow the use of surface mounting technique. The provided structure may be implemented without a surface mounted capacitor.

A dielectric material may have a relatively high dielectric permittivity $\in_r$, and a required capacitance value may be achieved due to an interlayer capacitance represented by a capacitor integrated into a substrate.

According to various examples, the resonant structure may be used for portable wireless chargers for various electronic devices including compact devices. For example, the resonant structure may be used for a charger for mobile phones. In medical fields, the resonant structure may be used for cardio stimulators, pacemakers, or other electronic devices including compact devices.

According to various examples, the resonant structure may provide an improved resonant structure capable of producing a high inductance value at a compact size device. In addition, a mutual inductance may take place wherever among inductive components of the resonant structure, and a total inductance of the structure may show a corresponding increase.

The units described herein may be implemented using hardware components, software components, or a combination thereof. For example, a processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such as parallel processors.

The software may include a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. In particular, the software and data may be stored by one or more non-transitory computer readable recording mediums.

The non-transitory computer readable recording medium may include any data storage device that can store data which can be thereafter read by a computer system or processing device. Examples of the non-transitory computer readable recording medium include read-only memory (ROM), random-access memory (RAM), CD-ROMs, magnetic tapes, floppy disks, optical data storage devices. Also, functional programs, codes, and code segments for accomplishing the example embodiments disclosed herein can be easily construed by programmers skilled in the art to which the embodiments pertain based on and using the flow diagrams and block diagrams of the figures and their corresponding descriptions as provided herein.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A self-resonant apparatus for a wireless power transmission system, the self-resonant apparatus comprising:

a plurality of ring resonators configured to transmit or receive wireless power, the plurality of ring resonators comprising split-ring resonators (SRRs) connected in parallel to capacitors, a front surface and a rear surface of each of the SRRs are connected and twisted in an alternating pattern, and each SRR comprises a metal strip mounted on a dielectric layer and is connected to a neighboring SRR by a series capacitor.

2. The self-resonant apparatus of claim 1, wherein the SRRs revolve, and an angle of the revolving is determined for a series surface-mounted capacitor to have an amount of space for mounting.

3. The self-resonant apparatus of claim 1, wherein the SRRs comprise a round or polygonal shape.

4. The self-resonant apparatus of claim 1, wherein a thickness of the dielectric layer comprises a range of 50 micrometers (μm) to 1500 μm.

5. The self-resonant apparatus of claim 1, wherein a dielectric permittivity of the dielectric layer comprises a value in a range of $2 \in_r$ to $20 \in_r$.

6. The self-resonant apparatus of claim 1, wherein the plurality of ring resonators comprise at least two SRRs.

7. The self-resonant apparatus of claim 1, wherein an operational frequency band of the SRRs comprises a range of 1 megahertz (MHz) to 100 MHz.

8. The self-resonant apparatus of claim 1, wherein the SRRs connected in parallel to the capacitors are manufactured by a low temperature co-fired ceramics technology or a printed circuit board technology.

9. The self-resonant apparatus of claim 1, wherein each SRR comprises an equivalent circuit comprising a parallel resonant LC circuit and a series capacitor.

10. The self-resonant apparatus of claim 9, wherein the parallel resonant LC circuit comprises an inductive element and a capacitive element, and is connected in series to resistor.

11. The self-resonant apparatus of claim 1, wherein, the combination is represented by an equivalent circuit comprising a plurality of cells, each cell comprises a parallel resonant circuit formed by an SRR and a capacitor being connected in parallel, and the plurality of cells are connected in series via the respective series capacitors.

12. The self-resonant apparatus of claim 11, wherein a combination of the parallel resonant circuit and the series capacitor is followed by revealing two resonant responses of typical impedance with respect to a metamaterial.

13. The self-resonant apparatus of claim 1, wherein a Q-factor of the combination comprises a value in a range of 100 to 200.

14. The self-resonant apparatus of claim 1, further comprising:

a magnetic rode disposed along an axis of the SRRs.

15. The self-resonant apparatus of claim 14, wherein the magnetic rode comprises ferrite.

16. The self-resonant apparatus of claim 1, wherein the capacitors are embedded in an internal portion of the dielectric layer comprising a dielectric permittivity that is above a predetermined threshold.

17. A resonant device, comprising:

a plurality of cells, each cell comprising a parallel resonant circuit configured to transmit or receive wireless power, the parallel resonant circuit includes a metamaterial and a capacitor which are arranged in parallel, wherein the plurality of cells are connected in series.

18. The resonant device of claim 17, wherein the metamaterial comprises a split-ring resonator (SRR).

19. The resonant device of claim 17, further comprising a plurality of series capacitors such that a respective series capacitor is disposed between each of the plurality of cells.

* * * * *